United States Patent [19]

Uchida et al.

[11] 4,376,304

[45] Mar. 8, 1983

[54] MOVING COIL TYPE STEREOPHONIC PICKUP CARTRIDGE

[75] Inventors: Ryuichi Uchida, Fussa; Kaoru Terasaki; Takeo Nishino, both of Kokubunji, all of Japan

[73] Assignee: Nippon Atsudenki Kabushiki Kaisha, Tokyo, Japan

[21] Appl. No.: 277,882

[22] Filed: Jun. 26, 1981

Related U.S. Application Data

[63] Continuation of Ser. No. 117,569, Feb. 1, 1980, abandoned.

[30] Foreign Application Priority Data

Jun. 22, 1979 [JP] Japan ..... 54-78961
Oct. 9, 1979 [JP] Japan ..... 54-130249

[51] Int. Cl.[3] ..... H04R 9/16
[52] U.S. Cl. ..... 369/136; 369/147
[58] Field of Search ..... 369/147, 146, 136, 170

[56] References Cited

U.S. PATENT DOCUMENTS

| | | | |
|---|---|---|---|
| 3,214,525 | 10/1965 | Eyck | 369/138 |
| 3,299,219 | 1/1967 | Madsen | 369/139 |
| 3,679,843 | 7/1972 | Cho | 369/147 |
| 3,729,596 | 4/1973 | Toth | 369/147 |
| 3,761,647 | 9/1973 | Nemoto | 369/139 |
| 4,124,783 | 11/1978 | Nemoto | 369/147 |
| 4,161,631 | 7/1979 | Matsuda | 369/147 |
| 4,209,670 | 6/1980 | Ono | 369/147 |

FOREIGN PATENT DOCUMENTS

| | | | |
|---|---|---|---|
| 1000035 | 8/1965 | United Kingdom | 369/147 |

*Primary Examiner*—Alan Faber
*Attorney, Agent, or Firm*—Barnes & Thornburg

[57] ABSTRACT

In a moving coil type stereophonic pickup cartridge, an armature is provided having first, second, and third leg portions which extend in three directions. A source of magnetic flux is disposed with only one pole thereof adjacent to the first, second and third leg portions of the armature. The magnetic circuits thus constructed, having an open return path, generate signals by changes in the magnetic flux through coils wound on the second and third leg portions due to the movement of the armature relative to the magnetic source. Variations in the design of the three leg armature and the magnetic source are disclosed. Practical embodiments of the invention include disclosure of cartridge replacement features providing convenient electrical connection between moving coils and remainder of the sound reproduction system.

13 Claims, 18 Drawing Figures

FIG. 6
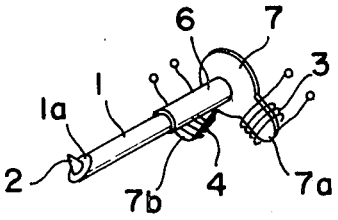
FIG. 7
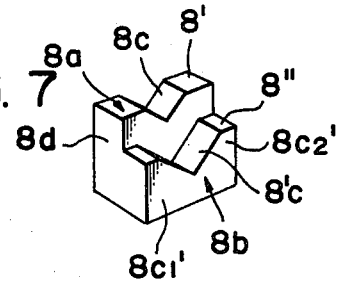
FIG. 8
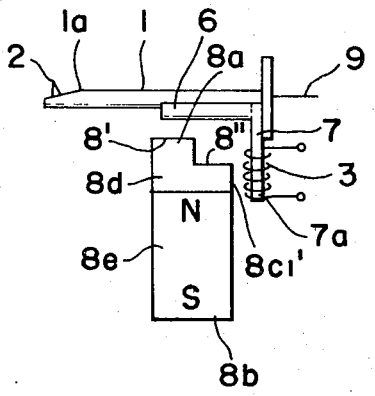
FIG. 9
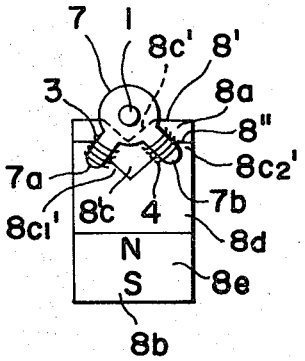
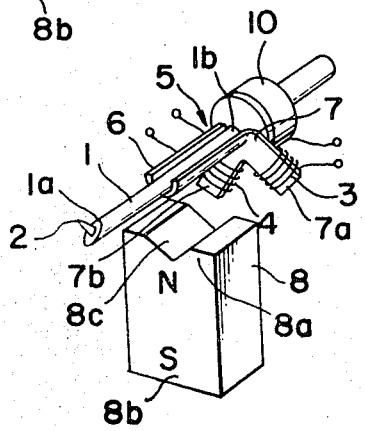
FIG. 10

MOVING COIL TYPE STEREOPHONIC PICKUP CARTRIDGE

This is a continuation of application Ser. No. 117,569 filed Feb. 1, 1980, now abandoned.

BACKGROUND OF THE INVENTION

1. Field of the Invention

This invention relates to a moving coil type stereophonic pickup cartridge of the type generally found in the U.S. Patent and Trademark Office under Class 369-136.

2. Description of the Prior Art

As described in U.S. Pat. No. 3,679,843, U.S. Pat. No. 3,299,219, and British Pat. No. 1,000,035, prior art stereophonic pickup cartridges of the moving coil type have been constructed such that a magnetic circuit is formed of a permanent magnet and pole pieces or yokes made of a high magnetic permeability material. At least one magnetic gap is provided in a part of the magnetic circuit, usually between the yokes. An armature on which moving coils are wound is attached to a rear portion of a cantilever. The cantilever is also provided with a stylus at the forward end portion and the armature is arranged in the magnetic gap. The stylus mounted on the cantilever traces the sound groove of a stereophonic disk record and, as the cantilever vibrates in accordance with the motions of the stylus, the coils of the armature move in the magnetic flux in the magnetic gap. Thus, electrical signals are induced in the moving coils corresponding to the undulations in the walls of the sound groove.

In order that the recorded sound in the high frequency range can be reproduced with high fidelity, the effective mass of the vibrational system i.e., the stylus, cantilever, armature and moving coils, is required to be reduced as much as possible. A direct consequence of reducing the mass of the coil is a generally smaller electrical output from the cartridge. The electrical output can be increased by increasing the density of the magnetic flux in the gap. This can be achieved by designing the magnetic gap to be narrower and/or increasing the magnetic power of the permanent magnet or other magnetic means employed to establish the magnetic flux in the gap. The increasing of the magnetic flux in the gap has usually resulted in an increase in the total mass of the cartridge which is attached to the tone arm. This increase in mass results in an increase in the moment of inertia of the tone arm at the stylus, causing poor tracking performance at the very low frequency range.

The very low frequency tracking problem is attributable to the general characteristics of disk records in as much as a disk record is typically made of a thermoplastic synthetic resin which may undergo warp when in storage or when handled improperly. A small but not ignorable number of the record disks commercially available have a center hole which is not concentric with the sound groove. As a result, unnecessary and harmful vibrations of the stylus tip may occur causing distortion of the reproduced sound. In the extreme case, the stylus disengages from the sound groove and skips across the disk usually damaging the disk and occasionally damaging the stylus. The harmful effects which are caused by the vibration of large amplitude and very low frequency ascribable to the warp and eccentricity of the disk are principally attributed to the fact that the moment of inertia measured at the stylus tip of the tone arm on which the cartridge is mounted is very large. Accordingly, the problems associated with large amplitude low frequency vibrations can largely be mitigated by reducing the mass of the tone arm and especially reducing the mass of the cartridge which contributes most to the moment of inertia at the stylus tip.

In order to reduce the mass of the cartridge as much as possible, it is necessary to reduce the mass of the permanent magnet or other source of magnetic flux and the associated yokes forming pole pieces. This has usually caused the electrical output generated through the moving coils to become unsatisfactorily small since the reduction of mass in the source of magnetic flux decreases the magnetic field intensity to an unsatisfactory level. As a result, it has been very difficult to improve the trackability in the very low frequency range of the cartridge through reducing the mass of the cartridge without also lowering the electrical signal output to a marginal level.

Thus, the principle object of the present invention is to provide a moving coil type stereophonic cartridge which has excellent trackability in the very low frequency range through reducing the effective mass of the tone arm but without lowering the electrical signal output. It is a further object of the present invention to keep the mass of the vibrational system as low as possible so that the recorded sound in the high frequency range can be reproduced with high fidelity.

SUMMARY OF THE INVENTION

According to the present invention, a moving coil type stereophonic pickup cartridge is provided with an armature having first, second and third leg portions which extend in three directions. The moving coils of the system are wound on the second leg and the third leg portions of the armature. A single source of magnetic flux is disposed with only one pole thereof adjacent to the first, second and third leg portions of the armature. No additional yokes or pole pieces in the usual sense are provided. Hence, the magnetic circuits thus formed consist essentially of the magnetic source, the respective leg portions of the armature, and an open return. Electrical signals are induced through the moving coils wound on the second and third leg portions of the armature on the basis of changes in the magnetic flux in the magnetic circuits caused by vibrations of the armature in response to undulations in the sound groove wall.

In a moving coil type stereophonic pickup cartridge according to the present invention the magnetic circuits consist essentially of an armature having leg portions which extend in three mutually orthogonal directions and a source of magnetic flux disposed with only one pole thereof adjacent to the armature. The removal of the gap forming magnetic pole pieces and yokes which are conventionally made of a high magnetic permeability material significantly lowers the overall mass of the cartridge thereby achieving more accurate tracking at low frequency despite record disk warp or eccentricity. The first leg portion of the armature is believed to improve the vertical magnetic characteristic (channels separation).

These and other features and advantages of the present invention will become apparent from a review of the exemplary embodiments thereof illustrated in the accompanying drawings and described more fully below.

BRIEF DESCRIPTION OF THE DRAWINGS

FIG. 6 is a perspective view of a stylus, cantilever, armature, and associated moving coils of another embodiment of the present invention.

FIG. 7 is a perspective view showing another embodiment of a magnetic source.

FIG. 8 is a side view of still another embodiment of the present invention.

FIG. 9 is a rear view of the embodiment illustrated in FIG. 8 as seen from the right of FIG. 8.

FIG. 10 is a perspective view showing yet another embodiment of the magnetic source and vibrational system according to the present invention.

DESCRIPTION OF THE PREFERRED EMBODIMENTS

Figure 1:
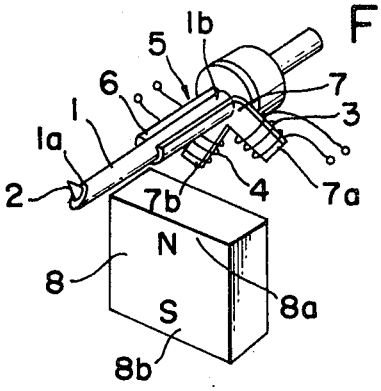
FIG. 1 is a perspective view showing one embodiment of a magnetic source and vibrational system according to the present invention.
Figure 2:
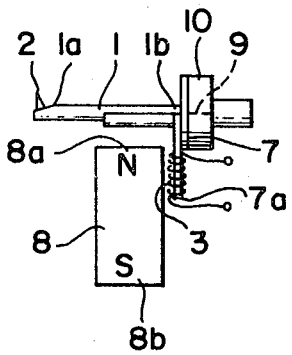
FIG. 2 is a side view of the embodiment illustrated in FIG. 1.
Figure 3:
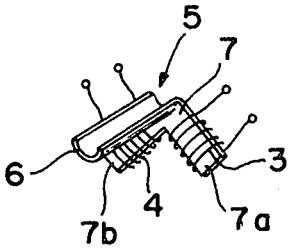
FIG. 3 is a perspective view of the armature and moving coils illustrated in FIG. 1.

Referring to FIGS. 1, 2 and 3, a cantilever 1 is provided with a stylus 2 at its front end 1*a* and an armature 5 at its rear end 1*b*. The armature 5 has a first leg portion 6, a second leg portion 7*a* and a third leg portion 7*b* which extend in three directions. Moving coils 3 and 4 are wound or otherwise mounted on leg portions 7*a* and 7*b* respectively.

The armature 5 is constructed as illustrated in FIG. 2 with a semi-cylindrical first leg portion 6 made of a high magnetic permeability material such as pure iron or permalloy. The second and third leg portions 7*a* and 7*b* are also composed of a high magnetic permeability material. Preferably the entire armature 5 is integrally formed from a single work piece by press molding or other similar process.

The semi-cylindrical first leg portion 6 of the armature 5 is mounted coaxially with the axis of the cantilever 1. The second leg protion 7*a* and the third leg portion 7*b* extend in directions in which their axes lie in a plane, preferably normal to the axis of the first leg portion 6. Further, the second leg portion 7*a* and the third leg portion 7*b* are separated by an angle equal to an angle which is defined by the side walls of a sound groove in a stereophonic disk record. Preferably the angle approximates 90° and thus the three leg portions of the armature 5 are mutually orthogonally related.

A magnetic source 8 is constructed of a permanent magnet. One pole 8*a* of the magnetic source 8 is arranged adjacent to the first leg portion 6, the second leg portion 7*a* and the third leg portion 7*b* of armature 5. Although in the illustration of FIG. 1, the north pole is arranged adjacent the armature 5 it would be appreciated by those skilled in the art that the south pole 8*b* rather than the north pole 8*a* could be so situated with substantially the same effect.

Figure 4:
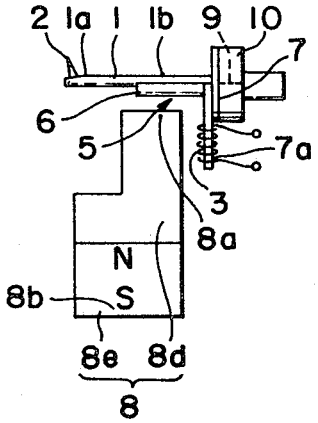
FIG. 4 is a side view showing another embodiment of the present invention with a modified magnetic source from that illustrated in FIG. 1.

Although a permanent magnet is employed as the magnetic source of the embodiment illustrated in FIGS. 1 and 2, it would also be possible to include as a part of the magnetic source a magnetic induction element 8*d* and a permanent magnet 8*e* as illustrated in FIG. 4. Consistent with the invention, only one pole 8*a*, the north pole as illustrated in FIG. 4, is arranged adjacent to the armature 5.

A plurality of magnetic circuits are formed by the arrangement of elements in FIGS. 1, 2, and 4. A first magnetic circuit consists of one pole 8*a* of the magnetic source 8, the first leg portion 6, the second portion 7*a* and an open return to the other pole 8*b* of the magnetic source 8. A second magnetic circuit consists of pole 8*a* of the magnetic source 8, the first leg portion 6, the third leg portion 7*b*, and an open return to the other pole 8*b* of the magnetic source 8. A third magnetic circuit consists of pole 8*a* of the magnetic source 8, the second leg portion 7*a*, and an open return to the other pole 8*b* of the magnetic source 8. Finally, a fourth magnetic circuit is present consisting of pole 8*a* of the magnetic source 8, the third leg portion 7*b* of the armature 5 and an open return to the other pole 8*b* of the magnetic source 8. The words "open return" are used here to indicate the absence of any high magnetic permeability yoke or frame in the return portion of the magnetic circuit which would ordinarily be present to form a defined magnetic gap.

Where the stylus 2 is vibrated in the vertical direction, the moving coil 3 on the second leg portion 7*a* of the armature 5 responds to a flux change in the first magnetic circuit described above. Likewise, a vibration in the vertical direction of stylus 2 generates a signal in moving coil 4 on the third leg portion 7*b* of the armature 5 in response to a flux change in the second magnetic circuit described above. Where the stylus 2 is vibrated in the horizontal direction, the moving coil 3 responds to a change in the magnetic flux of the third magnetic circuit while the moving coil 4 responds to a flux change in the fourth magnetic circuit described above. Thus, electrical signals in coils 3 and 4 are induced based on the vertical and horizontal directional components of motion of the stylus 2. In actuality, however, while the stylus 2 traces the sound groove of conventional stereophonic disk records recorded by the 45°–45° system, the recorded signals cause the stylus 2 to vibrate in many directions. Each vibration is in turn separated into its horizontal and vertical components and the associated signals are thus generated through the moving coils 3 and 4 by the appropriate changes in magnetic flux in the previously designated magnetic circuits.

As illustrated in FIGS. 2, 4, and 8, a fine wire or filament 9 of either metal or synthetic resin extends rearwardly from the rear end portion 1*b* of the cantilever 1 to suspend the cantilever with respect to the remaining portion of the cartridge. The suspension line 9 is usually appropriately tensioned and fixed through a damper 10. In this way, the point of vibration of the stylus as it traces the sound groove of the record disk is in the immediate vicinity of, but perhaps slightly behind, the intersection point of the axes of the three leg portions of the armature 5. The damper 10 serves to provide a very small restoring force to the vibrating system and to attenuate any ringing signal.

To further appreciate the signal generation it is helpful to consider the tracing of the sound groove on a record disk wherein only one of the right and left channels is recorded. Conventionally, the channel on the side of the second leg portion 7*a* of the armature 5 is taken to be the right channel for stereophonic signals. Similarly, the channel on the side of the third leg portion 7*b* is taken to be the left channel for stereophonic signals. Thus, when the stylus 2 traces the sound groove on a record disk in which only the right channel of the stereophonic signal is recorded, the second leg portion 7*a* of the armature 5 vibrates to cause a flux change in the associated magnetic circuit so that an electrical signal is induced through the moving coil 3 on the second leg portion 7*a*. In contrast, the third leg portion 7*b* executes merely a rotational motion in the magnetic field and hence no flux change occurs in the magnetic circuit so that an electrical signal is not generated through the moving coil 4. On the other hand, when stylus 2 traces the sound groove on a disk on which only the left channel of the stereophonic signal is recorded, the second leg portion 7*a* of the armature 5 rotates and the third leg portion 7*b* of the armature 5 vibrates such that, conversely to the foregoing case, the electrical signal is induced only through moving coil 4.

Figure 5:
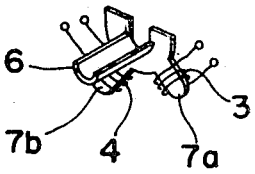
FIG. 5 is a perspective view of another armature and moving coil according to the present invention.

In the embodiment of the armatures illustrated in FIGS. 1–4, the second leg portion 7*a* and the third leg portion 7*b* are formed in such a manner as to protrude in the shape of the letter V. FIG. 5 illustrates a variation in the armature 5 which includes a small semi-circular portion with the second leg 7*a* and third leg 7*b* depending from the outer periphery of the semi-circular portion. Another modification of the armature 5 is illustrated in FIG. 6 in which the first leg portion 6 is in the shape of a pipe or tube made of a high magnetic permeability material. The armature element 7 is similarly made of a high magnetic permeability material and is circular with the second leg 7*a* and third leg 7*b* depending from the outer periphery of the circular portion. The armature 5 can be constructed in such a way that the respective elements 6 and 7 are formed of separate memebers which are then later intimately joined and thus magnetically coupled.

FIGS. 7 through 10 illustrate variations in the magnetic source 8. The end portions 8' and 8'' of the pole 8*a* of the elements 8 are stepped to provide a level or height difference from front and back of the magnetic source 8. Further, both end portions 8' and 8'' are provided with a groove or notch 8*c* and 8*c'* respectively. As illustrated in FIGS. 8 and 9, the groove is aligned with the axis of the cantilever 1 such that the notch 8*c* is adjacent to first leg portion 6 of the armature 5. The end faces 8*c*1' and 8*c*2'' on opposite sides of the notch 8*c''* are respectively held adjacent to the second leg 7*a* and third leg 7*b* of armature 5.

In FIG. 10, the step or level difference illustrated in FIGS. 7 through 9 is absent but the notch or groove 8*c* is still provided in pole 8*a* of the magnetic source 8. The presence of the notch or groove 8*c* permits cantilever 1 and magnetic source 8 to be brought closer to each other yet still provide the cantilever 1 with sufficient space to prevent actual contact when the cantilever 1 vibrates in its normal course. The groove or channel 8*c* also tends to focus the magnetic flux towards the first leg portion 6 of armature 5.

Figure 11:
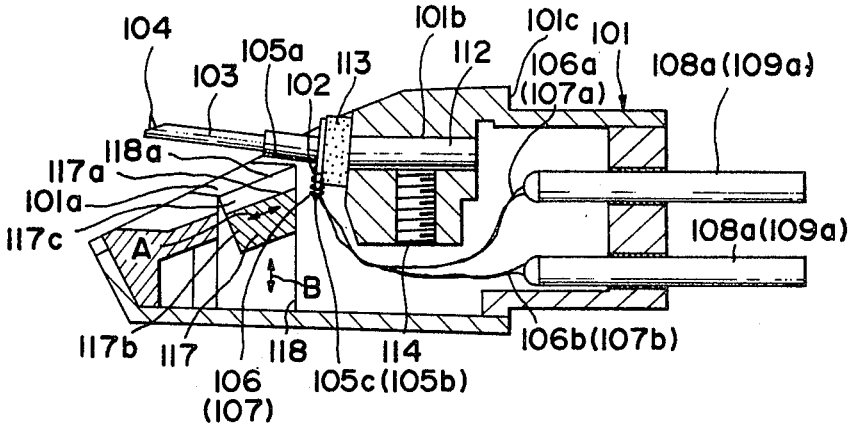
FIG. 11 is a sectional view of a stereophonic pickup cartridge according to the present invention.
Figure 12:
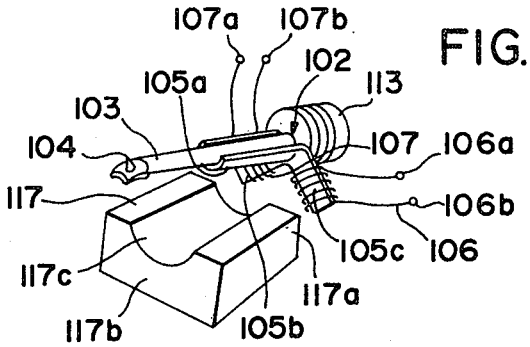
FIG. 12 is a perspective view showing the vibrational system and magnetic source of the embodiment illustrated in FIG. 11.
Figure 13:
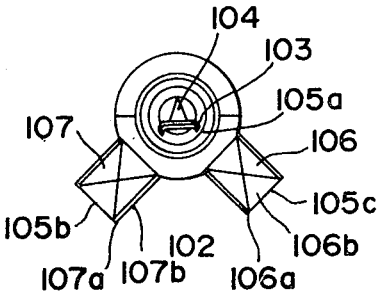
FIG. 13 is a front view of the vibrational system as it would be seen from the left side of FIG. 11.

One practical embodiment of the present invention is illustrated in FIGS. 11, 12 and 13, wherein the main body of the cartridge 101 of fiber reinforced resin includes a mounting hole 101*b*. A cantilever 103 and armature 102 is vibrationally supported from within the mounting hole 101*b* as will later be described in detail, the cantilever 103 projecting from the main body 101 through an opening 101*a*. A stylus 104 is mounted on the front end of the cantilever 103.

The armature 102 has a first leg portion 105*a* which extends in the axial direction of the cantilever 103, a second leg portion 105*b* and a third leg portion 105*c* which extend orthogonally to each other and with their axes intersecting substantially orthogonally to the axis of the first leg portion 105*a*. The respective leg portions 105*a*, 105*b* and 105*c* are made of a high magnetic permeability material and are magnetically coupled. Moving coils 106 and 107 are wound on the second leg 105*b* and the third leg 105*c* of the armature 102 respectively. The ends 106*a*, 106*b* and 107*a*, 107*b* of the moving coils 106 and 107 respectively are connected to terminal pins 108*a*, 108*b*, 109*a* and 109*b* respectively, the terminal pins being mounted in a rear portion of the main body 101.

Figure 15:
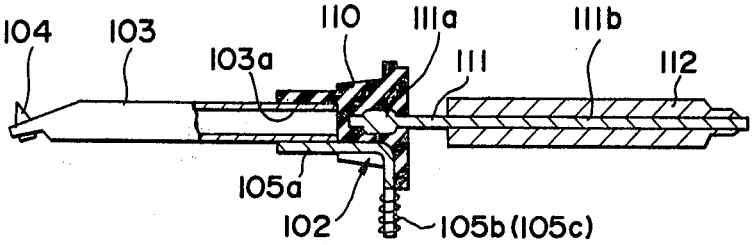
FIGS. 15 and 16 are sectional views each showing the detailed structure for supporting the armature, cantilever, and stylus on the main body of a cartridge.

The structure supporting armature 102 with respect to the main body 101 can be considered in detail by referring to FIGS. 11, 13 and 15 wherein it can be seen that the armature 102 and the cantilever 103 are contiguously joined by means of a coupling member 110 shown in detail in FIG. 15. The forward end 111*a* of wire 111 is enlarged in diameter and is embedded in the coupling member 110, the wire 111 extending along the axial extension line of the cantilever 103 rearwardly of the coupling member 110. The rearward end 111*b* of wire 111 is attached to a stopper pipe 112 there being a clearance between the stopper pipe 112 and the coupling member 110 to provide a point or region of vibration.

Figure 17:
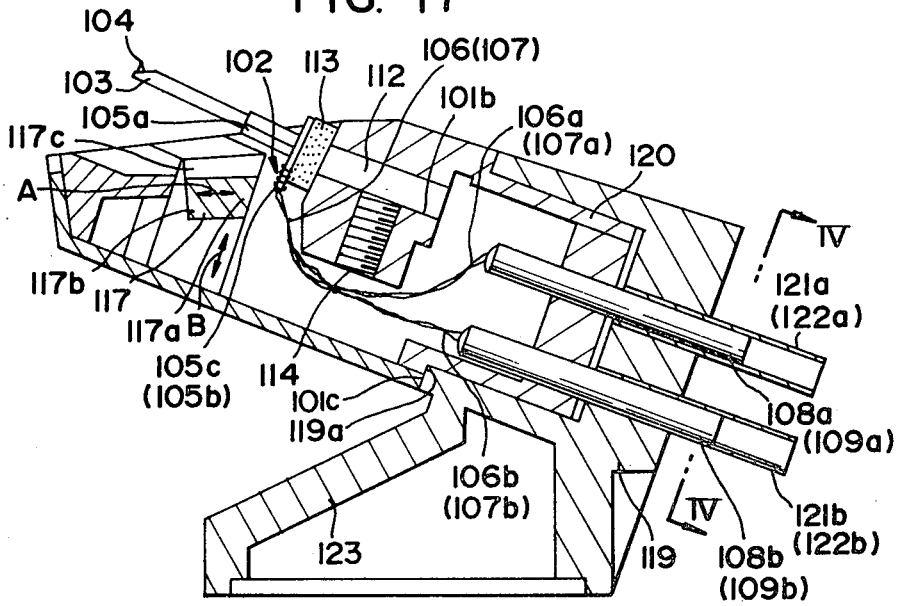
FIGS. 17 and 18 are sectional views showing two other embodiments of cartridges of the present invention in which the main body of the cartridge is mounted in a cartridge support.
Figure 18:
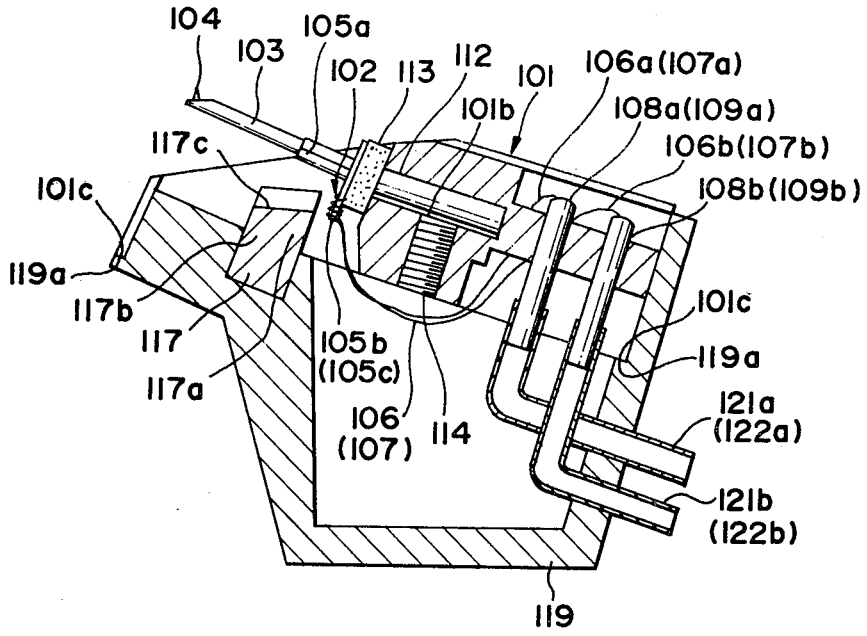

As shown in FIGS. 17 and 18, a damper 113 of butyl rubber or the like is interposed between the coupling member 110 and the stopper pipe 112 and the stopper pipe 112 is snuggly fitted into the mounting hole 101*b* in the main body 101. The damper 113 is slightly compressed between body 101 and coupling member 110 as the stopper pipe 112 is fully inserted into mounting hole 101*b* and fixed with respect to the main body 101 by means of screw 114. The vibrational fulcrum of the armature 102 then becomes positioned very close to, but rearward from, the intersection points between the first leg portion 105*a* and the second leg portion 105*b* on the suspension wire 111 within the region surrounded by damper 113.

Figure 16:
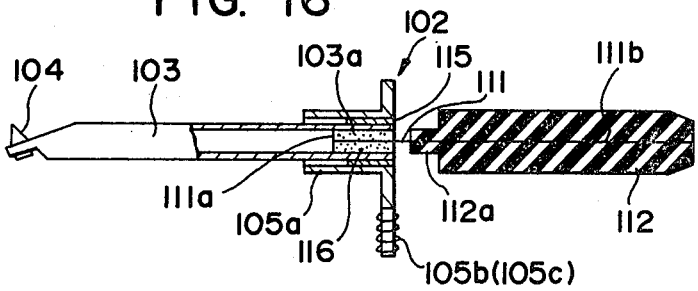

Another embodiment of the vibrating system is illustrated in FIG. 16 wherein the first leg portion 105*a* of the armature 102 is in the shape of a pipe or tube surrounding cantilever 103, the rear end 103*a* of the cantilever 103 being fixed within the first leg portion 105*a* by an appropriate adhesive 115. The forward end 111*a* of the wire 111 is fixed through a spacer 116 in the rear end 103*a* of cantilever 103 again by use of an adhesive. The stopper pipe 112 defining a clearance between it and the armature 102 is mounted on the rearward end 111*b* of wire 111. The stopper pipe 112 includes a reduced type of diameter portion 112*a* on the end of the stopper pipe closest to the armature 102. This vibrational system is mounted with respect to the main body 101 in a fashion similar to that previously discussed. The function of the reduced-diameter portion 112*a* is to confine the point of vibration on wire 111 to a point much closer to leg portions 105*a* and 105*b* than that provided by the structure illustrated in FIG. 15.

The relationship of the magnetic source to the armature in this embodiment can be considered in detail by considering FIGS. 11 and 12 illustrating the magnetic source 117 which is a permanent magnet preferably consisting of a rare-earth metal such as Samarium-Cobalt arranged so that only one pole 117*a* is adjacent to the first, second and third leg portions of armature 102. The other pole 117*b* of the magentic source 117 is spaced from and directed away from the armature 102. This structure results in four identifiable magnetic circuits, the first consisting of pole 117*a* of the magnetic source 117, the first leg portion 105*a*, the second leg portion 105*b*, and an open return to the other pole 117*b* of the magnetic source 117. The second magentic circuit consists of pole 117*a* of the magnetic source 117, the first leg portion 105*a*, the third leg portion 105*c*, and an open return to the other pole 117*b* of the magnetic source 117. A third magnetic circuit consists of one pole 117*a* of the magnetic source 117, the second leg portion 105*b* of the armature 102, and an open return to the other pole 117*b* of the magnetic source 117. Finally, the fourth magnetic circuit consists of pole 117*a* of the magnetic source 117, the third leg portion 105*c*, and an open return to the other pole 117*b* of the magnetic source 117.

Magnetic source 117 is provided with a U-shaped notch 117*c* so as to enhance the magnetic efficiency by bringing the magnetic source 117 and the armature 102 closer to each other. The magnetizing direction of the magnetic source 117 is such that that portion of the magnetic source 117 nearest to the first leg portion 105*a*, the second leg portion 105*b*, and the third leg portion 105*c* of the armature 102 are an identical pole. This is indicated by the direction of arrow A in FIG. 11. An alternative magnetic source could be employed having sufficient length that the magnetizing direction of the magnetic source 117 would be in the direction of arrow B in FIG. 11 and such magnetization would achieve substantially the same function. In order to make the positions of the armature 102 and the magnetic source 117 accurate, the main body 101 is provided with a slot 118. The magnetic source 117 is inserted in the slot 118 and its position fixed by shoulder 118*a* in slot 118.

It will be appreciated that with respect to both of the embodiments illustrated in FIGS. 17 and 18 the replacement of the stylus 104 is effected by replacement of the main body 101 and the entire vibrational system mounted therein, the electrical connection between the moving coils and the remaining portions of the disk record player being provided by the snuggly fitting terminal pins 108 and 109 and their respective tubes or pipes 121 and 122.

Figure 14:
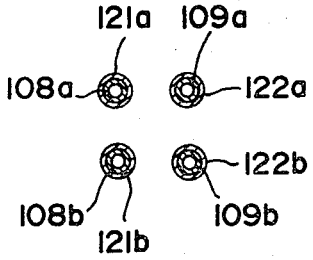
FIG. 14 is a sectional view taken along line IV—IV in FIG. 17.

A cartridge support 119 is illustrated in FIG. 17 which is provided with a cavity 120 for receiving the rear portion of main body 101 of the cartridge illustrated in FIG. 11. Hollow pipes or tubes 121*a*, 121*b*, 122*a*, and 122*b* are situated in the rear portion of cartridge support 119 so as to receive terminal pins 108*a*, 108*b*, 109*a* and 109*b* respectively. The interengagement of the pipes 121, 122 and the terminal pins 108, 109 is illustrated in cross-section in FIG. 14. The cartridge support 119 also includes a mounting portion 123 which is in turn mounted to the tone arm of a conventional disk record player (not shown). The main body of the cartridge 101 is telescopically received within the supporter 119, the shoulder 101*c* of the main body abutting on shoulder 119*a* of the cartridge support so as to accurately position the cartridge 101 when so inserted.

While in the embodiment illustrated in FIG. 17 the main body 101 is detachably assembled to the cartridge support 119 substantially in the axial direction of cantilever 103, an alternative embodiment of the cartridge support 119 is illustrated in FIG. 18 wherein the main body 101 is detachably assembled in a substantially orthogonal direction to the axis of the cantilever 103. As shown in FIG. 18, the terminal pins 108*a*, 108*b*, 109*a* and 109*b* are arranged to project orthogonally with respect to the cantilever and be received within the pipes 121*a*, 121*b*, 122*a* and 122*b* respectively. The tubes 121*a*, 121*b*, 122*a* and 122*b* are appropriately bent to exit from the rear wall of the cartridge support 119. The embodiment illustrated in FIG. 18 has the additional advantage that the magnetic source 117 can be mounted permamently in the cartridge support 119 so that replacement of the main body 101 does not include replacement of the magnetic source 117. The magnetic circuits in the embodiment illustrated in FIG. 18 are the same as those previously discussed with respect to the embodiment illustrated in FIGS. 11 and 17.

As illustrated above, the embodiments of the present invention rely on an open return rather than magnetic pole pieces and yokes defining any magnetic gap to provide the power generating mechanism in a moving coil type pickup cartridge. In this manner, the mass of the cartridge is remarkably reduced and the moment of inertia at the stylus tip point of the tone arm is efficiently lessened when the cartridge is mounted in the tone arm. As a consequence, it is possible to eliminate harmful effects caused by very low frequency and particularly large amplitude vibrations which may be ascribable to disk warp, sound groove eccentricity, and the like.

What is claimed is:

1. A moving coil type stereophonic pickup cartridge comprising:

a. a body, a cantilever vibrationally supported at its rearward end by the body, and a stylus fixed to the forward end of the cantilever;

b. an armature made of high magnetic permeability material fixed to the cantilever for movement therewith, the armature comprising a first leg portion, a second leg portion, and a third leg portion, the first leg portion fixed to the rearward portion of the cantilever and arranged parallel to the axial direction of the cantilever, and the second and third leg portions extending radially from the axis of said first leg portion;

c. a pair of moving coils, one each of the coils being situated on the second leg portion and on the third leg portion of said armature;

d. a magnetic source, only one pole of which is adjacent to the three leg portions of the armature; and e. an open return path from the three leg portions of the armature to the other pole of the magnetic source remotely situated with respect to the armature.

2. The moving coil type stereophonic pickup cartridge according to claim 1 wherein the magnetic source is constructed of a permanent magnet with only one of the north and south poles of said permanent magnetic being adjacent to the armature.

3. The moving coil type stereophonic pickup cartridge according to claim 1 wherein the three leg portions of the armature are mutually orthogonal to each other, said second leg and third leg portions being arranged with respect to the stylus such that they are perpendicular to the side wall of any stereophonic sound groove into which the stylus would be placed.

4. The moving coil type stereophonic pickup cartridge according to claim 1 wherein said first leg portion of the armature is tubular and situated coaxially with respect to the cantilever, and said second and third leg portions comprise a unitary flat armature element contiguous to the rearward end of the first leg portion of the armature.

5. The moving coil type stereophonic pickup cartridge according to claim 1 wherein said armature is unitary, the first leg portion being semi-cylindrical, the semi-cylindrical portion being fixed coaxially with respect to said cantilever.

6. The moving coil type stereophonic pickup cartridge according to claim 5 wherein said armature further comprises a semi-circular disk shaped portion from which said second and third leg portions depend integrally.

7. The moving coil type stereophonic pickup cartridge according to claim 1 wherein said magnetic source further comprises a groove in the face thereof nearest the armature, the groove being parallel to the axis of the cantilever.

8. The moving coil type stereophonic pickup cartridge according to claim 1 wherein said magnetic source further comprises a step in the end thereof closest to the armature, the lower level of said step being immediately adjacent to said second and third leg portions of the armature.

9. The moving coil type stereophonic pickup cartridge according to claim 1 further comprising four terminal pins fixed to said body, each terminal pin being connected to an end of one of said pair of moving coils.

10. The moving coil type stereophonic pickup cartridge according to claim 9 further comprising a support means for supporting the cartridge body with respect to a tone arm, the support means having four tubes for detachably receiving said four terminal pins.

11. The moving coil type stereophonic pickup cartridge according to claim 10 wherein said magnetic source is fixedly mounted in said support means to be retained therein in the event of replacement of the cartridge body.

12. A moving coil type stereophonic pickup cartridge comprising:

a. a body, a cantilever vibrationally supported at its rearward end by the body, and a stylus fixed to the forward end of the cantilever;

b. an armature made of high magnetic permeability material fixed to the cantilever for movement therewith, the armature comprising a first leg portion, a second leg portion, and a third leg portion, the first, second, and third leg portions being fixed to the cantilever in the immediate vicinity of the vibration fulcrum of said cantilever, the first leg portion fixed to the rearward portion of the cantilever and arranged parallel to the axial direction of the cantilever, the axes of the second and third leg portions being substantially orthogonal to that of the first leg portion, and the angle between the axes of the second and third leg portions being set at an angle which is formed by side walls of a stereophonic record disc sound groove, the second and third leg portions extending from the first leg portion;

c. a pair of moving coils, one each of the coils being situated on the second leg portion and on the third leg portion of said armature; and d. a magnetic source, only one pole of the magnetic source being in the vicinity of the vibration fulcrum of the cantilever, and the first, second, and third leg portions of the armature and their extensions which extend from the cantilever thus forming an open return.

13. A moving coil type stereophonic pickup cartridge comprising:

a. a body, a cantilever vibrationally supported at its rearward end by the body, and a stylus fixed to the forward end of the cantilever;

b. an armature made of high magnetic permeability material fixed to the cantilever for movement therewith, the armature comprising a first leg portion, a second leg portion, and a third leg portion, the first leg portion fixed to the rearward end portion of the cantilever and arranged parallel to the axial direction of the cantilever, and the second and third leg portions extending radially from the axis of said first leg portion;

c. a pair of moving coils, one each of the coils being situated on the second leg portion and on the third leg portion of said armature; and d. a magnet, only one pole of which is adjacent to the three leg portions of the armature, the one pole having a groove in the face thereof nearest the armature, the groove being parallel to the axis of the cantilever, whereby the magnetic circuits thus formed consist essentially of the magnet, the respective leg portions of the armature, and an open return.

* * * * *